US007993577B2

(12) United States Patent
Duz et al.

(10) Patent No.: US 7,993,577 B2
(45) Date of Patent: Aug. 9, 2011

(54) COST-EFFECTIVE TITANIUM ALLOY POWDER COMPOSITIONS AND METHOD FOR MANUFACTURING FLAT OR SHAPED ARTICLES FROM THESE POWDERS

(75) Inventors: Volodymyr A. Duz, Hudson, OH (US); Orest M. Ivasishin, Kiev (UA); Vladimir S. Moxson, Hudson, OH (US); Dmitro G. Savvakin, Kiev (UA); Vladislav V. Telin, Zaporozhye (UA)

(73) Assignee: Advance Materials Products, Inc., Hudson, OH (US)

( * ) Notice: Subject to any disclaimer, the term of this patent is extended or adjusted under 35 U.S.C. 154(b) by 570 days.

(21) Appl. No.: 11/811,578

(22) Filed: Jun. 11, 2007

(65) Prior Publication Data

US 2009/0252638 A1 Oct. 8, 2009

(51) Int. Cl.
*B22F 3/16* (2006.01)

(52) U.S. Cl. ..... 419/39; 419/44; 419/36; 419/23; 419/32; 419/50; 419/53; 419/54; 419/58

(58) Field of Classification Search ..... 419/37, 419/39

See application file for complete search history.

(56) References Cited

U.S. PATENT DOCUMENTS

| | | | | |
|---|---|---|---|---|
| 3,472,705 | A | 10/1969 | Gregory | |
| 3,950,166 | A * | 4/1976 | Obara et al. | 419/33 |
| 4,432,795 | A | 2/1984 | Andersen | |
| 4,838,935 | A | 6/1989 | Dunlop et al. | |
| 5,441,695 | A | 8/1995 | Gladden | |
| 6,551,371 | B1 | 4/2003 | Furuta et al. | |
| 6,849,230 | B1 * | 2/2005 | Feichtinger | 420/417 |
| 2003/0211001 | A1 * | 11/2003 | Ivasishin et al. | 419/39 |
| 2005/0175495 | A1 * | 8/2005 | Rak et al. | 419/2 |

FOREIGN PATENT DOCUMENTS

| | | |
|---|---|---|
| CH | 684978G A3 | 2/1995 |
| JP | 58-34102 | 2/1983 |
| JP | 6-88153 | 3/1994 |
| JP | 6-92605 | 11/1994 |
| JP | 7-278609 | 10/1995 |
| WO | WO 97/01409 | 1/1997 |

* cited by examiner

*Primary Examiner* — Roy King
*Assistant Examiner* — Christopher Kessler
(74) *Attorney, Agent, or Firm* — Buchanan, Ingersoll & Rooney PC

(57) ABSTRACT

The invention relates to manufacture of titanium articles from sintered powders. The cost-effective initial powder: 10-50 wt % of titanium powder having ≦500 microns in particle size manufactured from underseparated titanium sponge comprising ≦2 wt % of chlorine and ≦2 wt % of magnesium; 10-90 wt % of a mixture of two hydrogenated powders A and B containing different amount of hydrogen; 0-90 wt % of standard grade refined titanium powder, and/or 5-50 wt % of alloying metal powders. The method includes: mixing powders, compacting the blend to density at least 60% of the theoretical density, crushing titanium hydride powders into fine fragments at pressure of 400-960 MPa, chemical cleaning and refining titanium powders by heating to 300-900° C. and holding for ≦30 minutes, heating in vacuum at 1000-1350° C., holding for ≦30 minutes, and cooling.

14 Claims, No Drawings

COST-EFFECTIVE TITANIUM ALLOY POWDER COMPOSITIONS AND METHOD FOR MANUFACTURING FLAT OR SHAPED ARTICLES FROM THESE POWDERS

FIELD OF INVENTION

The present invention relates to powder metallurgy of titanium alloys, and can be used in aircraft, automotive, armor, and Naval applications, oil equipment, chemical apparatus, and other industries. More particularly, the invention is directed to the cost-effective manufacture of near-net shape titanium articles by room temperature consolidation and sintering elemental and alloyed powders.

BACKGROUND OF THE INVENTION

Titanium alloys are well known for their lightweight, high resistance to oxidation or corrosion, as well as the highest specific strength (the strength-to-weight ratio) amid all metals except beryllium. Currently, titanium alloy parts have been produced by ingot metallurgy processes including melting, forming and machining (processes), or by powder metallurgy techniques. The first method is not cost effective but provides high levels of all properties of titanium alloys. The second method is cost effective but cannot completely realize all advantages of titanium alloys due to inferior mechanical properties.

Various powder metallurgy processes have been developed during the last three decades for the fabrication of near-net shape titanium articles with density and mechanical properties acceptable for the intended applications. The use of elemental powder mixtures, controlling the particle size distribution, vacuum sintering, hot isostatic pressing, and special surface finishing are among those new developments. But all of these processes, as well as conventional powder metallurgy techniques, impose certain limitations with respect to the characteristics of the produced titanium alloys.

For example, a method for producing sintered articles from a titanium powder alloy disclosed in JP 06092605, 1998 includes molding a mixture of elemental powders, vacuum sintering, hot isostatic pressing of the alloy in $\alpha+\beta$ region, and shot pinning to heal surface porosity. The irregular porosity in the interior portion of the sintered articles is the drawback of this method, which degrades the mechanical properties, especially the strength.

The method for producing titanium alloys from elemental powders disclosed in JP 129864, 1990, includes pressing of the powder mixture, vacuum sintering, quenching of the alloy in $\beta$-region, and hot pressing at a temperature over 800° C. The oxidation taking place during hot pressing reduces mechanical properties.

The method described in the U.S. Pat. No. 4,432,795 includes grinding particles of light metals to the particle size less than 20 μm, mixing them with particles of titanium based alloys having a particle size larger than 40 μm, and compacting the mixture by molding and sintering at temperatures less than that of a formation of any liquid phase. This method allows the manufacture of the alloy having a density close to the theoretical value but the resulting alloy, contaminated by oxygen, iron, and other impurities, also exhibits reduced mechanical properties preventing its use for critical applications.

The U.S. Pat. No. 4,838,935 describes the use of titanium hydride together with titanium powder in the primary mixture before molding and sintering. The molded article is heated in a hot-press vacuum chamber to a temperature sufficient for the dehydration of $TiH_2$ to remove gases. Then, the article is heated to a temperature of 1350-1500° C. while maintaining the pressure and vacuum. This method cannot completely prevent the oxidation of highly-reactive titanium powders during the second heating, because hydrogen is permanently outgassing from the working chamber. Besides, this method is not suitable for powdered mixtures containing low-melting metal and phases.

A preliminary partial sintering of titanium and titanium hydride powders with elemental powders of alloying metals is disclosed in U.S. Pat. No. 3,950,166 granted to K. Obara et al. The "mother" alloy obtained in such a way is pulverized and remixed with powder metals such as Mo, V, Zr, and Al—V master alloy to achieve the final composition of titanium alloy. This mixture is molded in a predetermined shape and sintered at 1000-1500° C. in a vacuum. The preliminary sintering partially improves distribution of alloying components, but creates oxidation of the "mother" powder during pulverization.

The method of said U.S. Pat. No. 3,950,166 includes two sintering stages (preliminary sintering and final sintering) at constant pressure of vacuum or argon, and pulverization of the preliminary sintered master alloy. Such complex process is necessary because a metallurgical reaction between alloy components is not completed within the first sintering stage. Hydrogen does not participate in the reaction due to permanent outgassing during vacuum sintering or diluting by argon when sintering performed in argon. In order to complete the reaction and obtain uniform composition of required alloy, this method includes additional pulverization of master alloy, adding new portion of the components, and re-sintering. And after such an extremely labor consuming and not effective processing, the final articles have density only 95-98% of the theoretical value. Low density and low strength of the final product is caused by said additional pulverization because each additional pulverization of titanium-containing metals results in additional oxidation and accumulation of microstructural defects and impurities.

The U.S. Pat. No. 5,441,695 granted to T. Gladden is one of the patents related to sintering of titanium hydride powder. However, this process relates to the manufacture of the material containing Titanium Nitride compound because the final step of the process disclosed by this patent is sintering at 1200° C. in nitrogen atmosphere. The author called this atmosphere as non-reactive, but this may be a questionable determination because nitrogen is reactive atmosphere for titanium powder. The compound of TiN is formed over 800° C., and solubility of nitrogen in solid titanium is about 6 wt. % after heating at 1200° C. [see Vol A.E. Structure and Properties of Binary Metal Systems, v. 1, 1959, p. 145]. Such high level of nitrogen is absolutely inadmissible in any titanium alloys used for structural parts in any industrial applications. But, Titanium Nitride is desirable for decoration purposes due to gold-like brilliant color of this compound. Coloring of titanium was a goal of the U.S. Pat. No. 5,441,695, which is clear from the title and from the Example, wherein "the sintered part has an intense, brilliant appearance" (line 46 in column 4). Thus, this patent is not applicable to the manufacture of any structural titanium alloys including titanium alloys containing aluminum and vanadium due to the formation of aluminum nitrides and vanadium nitrides degrading mechanical properties of the titanium alloys. Moreover, the product manufactured according to this patent is full of oxygen and hydrogen too, as it is shown below.

The U.S. Pat. No. 6,551,371 granted to T. Furita, et al. also discloses the use of titanium hydride, however, there is no titanium hydride neither in claims nor in examples, only dehydrated titanium powder was used everywhere. The particle size ratio mentioned in this patent relates to the particles of titanium boride and particles of elemental alloying metals such as aluminum, zirconium, silicon, etc. The ratio mentioned in the claim 15 relates to particles of $TiB_2$, TiC and $Y_2O_3$. These ratios are needed to optimize compaction and to provide uniform distribution of reinforcing particles along of the composite structure. This means that said ratios of particle sizes are not effective for homogenizing chemical composition of the matrix titanium alloy.

Several attempts have been made to improve the density and purity of sintered titanium alloys by using titanium hydride as the raw component, together with other alloying powders, as in JP 07278609, 1995, or JP 06088153, 1994, or U.S. Pat. No. 3,472,705, 1969, or WO 9701409, 1997. All of these methods include vacuum heating and sintering accompanied with permanent outgassing. So, the "cleaning effect" of hydrogen is not used properly, and partial oxidation reoccurs after the removal of hydrogen from the vacuum chamber. Thus, these methods do not provide an effective improvement of mechanical properties of sintered alloys, in spite of the sintering promoted by thermal dissociation of titanium hydride.

Some specialized technologies were offered to manufacture titanium alloys in hydrogen atmosphere in JP 58034102, 1983 and CH 684978, 1995. These methods cannot prevent the contamination of sintered metals as well as the methods mentioned above: after the replacement of a hydrogen-containing atmosphere by an inert gas, the oxidation of reactive powders reoccurs.

All other known processes for making near-net shape titanium alloys from metal powders have the same drawbacks: (a) insufficient purity and low mechanical properties of sintered titanium alloys, (b) irregular porosity and insufficient density of sintered titanium alloys, and (c) low reproduction of mechanical properties that depend on the purity of raw materials.

OBJECTIVES OF THE INVENTION

The object of the invention is to increase the mechanical properties, particularly strength and plasticity, of near-net shape articles manufactured by sintering titanium alloys from elemental and/or alloyed metal powders by using low cost room temperature consolidation such as die pressing, cold isostatic pressing, direct powder rolling followed by vacuum sintering. Metal injection molding process followed by sintering is another objective of this invention.

Yet, another objective of the present invention is to provide low porosity and high-density structures of sintered titanium alloys to achieve the densities close to the theoretical value.

It is also an objective to provide the cost-effective manufacture of near-net shape articles using one run heating and sintering of powdered titanium alloys.

The nature, utility, and further features of this invention will be more apparent from the following detailed description, with respect to preferred embodiments of the invented technology.

SUMMARY OF THE INVENTION

The invention relates to the cost-effective manufacture of near-net shape titanium articles from sintered powders containing titanium and all required alloying elements. While the manufacture of titanium alloys by sintering elemental and alloyed metal powders including titanium hydride has previously been contemplated as mentioned above, problems related to insufficient strength, irregular porosity, insufficient density, and cost reductions have not been solved.

The invention overcomes these problems by:

(a) preparing cost-effective initial powder composition for subsequent room temperature consolidation and sintering. The composition comprises:
- 10-50 wt. % of underseparated titanium powder with less than 500 μm in particle size manufactured from underseparated titanium sponge comprising up to 2 wt. % of chlorine and up to 2 wt. % of magnesium. The underseparated titanium powder costs significantly less than that for fully separated powder of completely reduced sponge, because the final refining stages are most time-consumable and expensive operations in the process of purification of titanium sponge;
- 10-90 wt. % of hydrogenated titanium powder, whereby this powder is a mixture of two hydrogenated powders A and B containing different amount of hydrogen: powder A contains amount of hydrogen in the range of 0.2-1 wt. % and powder B contains amount of hydrogen in the range of 2-3.9 wt. %. The powder with high hydrogen content provides purification of underseparated titanium powder during heat treatment and sintering, while the powder with low hydrogen content provides sufficient strength of green compacts as well as perfect structure and quality of the final sintered article;
- 0-90 wt. % of standard grade refined titanium powder, and/or
- 5-50 wt. % of alloying metal powders: master alloys or elemental powders,
- the ratio between particle sizes of titanium powder, hydrogenated titanium powder, and alloying powders is in the range of 1:(0.5-2):(0.01-0.7).

(b) using the cost-effective method for manufacturing flat or shaped articles. The method includes:
- mixing above mentioned underseparated titanium powder manufactured from underseparated titanium sponge, the standard grade refined titanium powder, the titanium hydride powders containing different amount of hydrogen, and the master alloys or elemental alloying powders in the ratio providing the composition of the required alloy,
- compacting the obtained blend by room temperature consolidation such as die pressing, molding, direct powder rolling, cold isostatic pressing, and/or metal injection molding to density at least 60% of the theoretical density,
- additional crushing titanium hydride powders into fine fragments during room temperature consolidation compacting at the pressure in the range of 400-960 MPa to provide forming a uniform network of fine pores promoting healing effects during sintering,
- chemical cleaning and refining titanium powders in the consolidated compacted articles by heating to 300-900° C. and holding for at least 30 minutes to provide a reaction of chlorine, magnesium, oxygen, and other impurities with hydrogen emitted due to decomposition of titanium hydride,
- heating in vacuum for sintering in β-phase zone of titanium in the temperature range of 1000-1350° C. and holding for at least 30 minutes, and cooling.

Also, the cost-effective method for manufacturing flat or shaped titanium articles includes heating to the sintering temperature of the predetermined alloy composition at variable pressures in the furnace chamber: initially heating to 400° C.

in vacuum of less than $10^{-2}$ Pa, then, heating in a range of 400-900° C. at pressure up to $10^4$ Pa controlled by hydrogen being emitted due to the decomposition of titanium hydride contained in the compacted powdered alloy, and finally, heating to over 900° C. to the sintering temperature at the pressure continually decreasing to the starting vacuum level providing purification of original titanium powder contaminated with chlorine, magnesium, oxygen and other impurities.

The core of the invention is to control of purity and mechanical properties of sintered titanium alloys using (a) low cost underseparated titanium powder manufactured from underseparated titanium sponge, (b) hydrogenated titanium powders having varied content of hydrogen and predetermined particle size as the base component, (c) optimal ratio of particle size between underseparated titanium powder, hydrogenated titanium powders, and alloyed metal powders, (d) chemical purification of titanium powders immediately during the sintering process, and (e) variable pressure of hydrogen in the furnace chamber during the heating, sintering and (f) cooling process.

DETAILED DESCRIPTION AND PREFERRED EMBODIMENTS OF THE INVENTION

As discussed, the present invention relates generally to the manufacture of sintered titanium alloy(s) parts using Commercially Pure (C.P.) grade titanium powders mixed with elemental metal powders and hydrogenated titanium powders as raw materials. Optimal size distribution of raw metal powders and the prevention of their oxidation during heating and sintering play a very important role in such processes.

No previously known methods, also mentioned in References, tried to find out the cost-effective composition of the powder mixture and optimal ratio between the particle size of hydrogenated titanium (or titanium hydride) powder and the particle size of metal powders alloying the titanium base. The known methods always used finally purified expensive powders and traditional sintering process with permanent outgassing of the vacuum chamber during heating and sintering. Therefore, a complete reaction between metal powders and green titanium compacts with hydrogen is not achieved, and the final structure of the sintered alloy contains increase concentration of oxides and irregular porosity.

According to our invention, the cost of the raw powder mixture is drastically decreased due to the use low cost underseparated titanium powder manufactured from underseparated titanium sponge which contain up to 2 wt. % of chlorine and up to 2 wt. % of magnesium. Said underseparated titanium powder costs significantly less than the fully-separated powder of completely reduced sponge, because the final refining stages are most time-consumable and expensive operations in the process of purification of titanium sponge. The part of raw powder represented by this low cost underseparated titanium powder can reach 50% of total weight of initial powder mixture.

However, we recommend to use 10-20 wt. % of underseparated titanium powder with less than 2 mm in particle size manufactured from underseparated titanium sponge comprising up to 2 wt. % of chlorine and up to 2 wt. % of magnesium. If the amount of underseparated titanium powder is in the range of 20-50 wt. %, it should comprise only up to 1 wt. % of chlorine and up to 1 wt. % of magnesium. Otherwise, the raw powder mixture would be highly contaminated that could minimize self-cleaning effect during sintering operation and degrade the properties of the as-sintered alloys.

Another novelty of this invention is the work with base powders hydrogenated to various content of hydrogen that provides flexibility of preparing the raw mixture and improves sintering process since it ensures dimensional stability of the final sintered titanium article. Besides, using of lower than stoichiometric content of hydrogen could be economically advantageous due to lower cost of hydrogenation.

We discovered that high hydrogen content (up to 3.9 wt. %) in the base titanium powder is an important variable for the attainment of the highest density regardless of consolidation pressure. On the other hand, lower hydrogen content (up to 1 wt. %) in hydrogenated titanium is advantageous because a lower shrinkage during sintering is more important factor when the tolerances of sintered parts have more critical requirements for a particular application. Besides, lower hydrogen content is desirable to improve strength of green compacts, which is important at complicated shape of articles (holes, thin walls, etc.). With higher hydrogen content, the chemical purification effect (including reduction of oxygen and chlorine) is expected to be more pronounced. Microstructure of final titanium alloy was not noticeable different at various content of hydrogen in raw titanium powder.

The ratio of hydrogenated and C.P Titanium powders in the raw mixture also plays an important role. On the one hand, the particle size of the titanium base and alloying metal powders should be as small as possible to enhance the chemical homogenization and to reach high final density of the sintered alloy. The smaller the particle size of raw metal powders, the more chemical contaminants are coming into the powder mixture to be molded and sintered. We discovered that a hydrogenated titanium powder mixture should comprise powder A with about 3.9 wt. % of hydrogen and particle size less than 250 μm, while powder B has less than 1 wt. % of hydrogen and particle size less than 100 μm. The alloying metal powder containing 60 wt. % of aluminum and 40 wt. % of vanadium has particle size less than 70 μm. The ratio between particle sizes of titanium powder, hydrogenated titanium powder, and alloying powders is in the range of 1:(0.5-2):(0.01-0.7).

This ratio between particle sizes of raw powders is the optimum to obtain a fully dense, strong structure of resulting titanium alloy. These sizes of raw metal powders achieve a high rate of homogenization and higher density of the sintered alloy and resulted in reduced impurity level promoting the improved mechanical properties.

The use of hydrogenated titanium powder (at least partially) as the base component instead of only C.P. titanium powder promotes rapid phase formation and activation during (of) sintering of powdered preforms. The hydrogenated titanium is decomposed during the vacuum heating with the emission of hydrogen in the range of 400-900° C. that results in the formation of titanium having high density of crystalline defects which promotes the diffusion process.

The emitted atomic hydrogen beneficially effects on sintering kinetics, reduces any oxides and chlorides formation that are usually located on the surface of powder particles, and by doing so, is cleaning inter-particle interfaces and enhances the diffusion between all components of the powder mixture.

In order to use this positive effect, it is necessary to maintain a high concentration of hydrogen in room temperature consolidated preforms and provide its permanent emission during the heating process from room to the sintering temperature. We are using increased partial pressure of hydrogen in the furnace chamber up to $10^4$ Pa in the temperature range of 400-900° C. to keep hydrogen in the crystalline lattice of titanium up to 900° C. High pressure of ambient hydrogen prevents a decrease in the concentration of hydrogen dissolved in titanium that usually takes place with an increase in sintering temperature.

Further heating and sintering is carried out by outgassing hydrogen from the working chamber to the remaining pressure of $10^{-2}$ Pa to remove the hydrogen from the metal and to transform the multiphase powder mixture into a chemically homogeneous and fully dense alloy. Such change in the hydrogen pressure during the processing of titanium powders increases mechanical properties of the resulting alloy, especially the strength and plasticity. Thus, the positive effect of hydrogen is used in the heating stage. The hydrogen cannot be present in the vacuum chamber during the final stages of sintering in order to prevent its negative effect on properties of the solid sintered alloy.

On the other side, the particle size of low-melting alloying powders in the alloy mixture should not be larger than ⅖ of the particle size of base titanium powder to provide a complete solid-phase reaction of low-melting powders (for example, elemental aluminum) with titanium, before they reach their melting points to avoid a significant porosity. The use of larger low-melting powders resulted in the partial or even complete liquid-phase reaction with the titanium base, because coarse low-melting powders or their eutectics are melted during the heating earlier than the diffusion processes would occur. This premature liquid-phase reaction on the heating stage resulted in an incomplete densification and homogenization of the alloy composition that cannot be improved by subsequent sintering and annealing.

Thus, the above-mentioned ratio of particle sizes between titanium hydride powder and other metal powders in the raw mixture was experimentally proven, and can be considered as the optimal ratio.

Room temperature consolidation powders to preforms of desired near-net shape is carried out at the pressure of 400-960 MPa. The pressure less than 400 MPa is insufficient for molding. On the other hand, cracks in the molded preforms occur at the pressures over 960 MPa. Metal injection molding of powders may be performed at lower pressures, such as ≦900 MPa.

The heating of molded near-net shape preforms is carried out at a rate of 10-15° C./min to prevent extra distortion or cracking. The preforms crack at the rate of >15° C./min because the hydrogen emission from the decomposed titanium hydride is too intense. The rate of <10° C./min is too low and expensive and has no beneficial affect on any improvements in properties of the processed alloy.

The hydrogen emission at a temperature less than 400° C. is insignificant, and the temperature higher than 900° C. is nearly complete. Therefore, the pressure of hydrogen is controlled in the working chamber in the temperature range of 400-900° C.

The return of the pressure in the working chamber to the level of less than $10^{-2}$ Pa accompanied with the heating from 900° C. to the sintering temperature results in complete removal of hydrogen from the sintered alloy. The absence of hydrogen prevents the deterioration of mechanical properties of titanium alloy, especially preventing a hydrogen-ignited brittleness.

The innovated technology allows the manufacture of chemically homogeneous titanium alloys with high densities and mechanical properties exceeding or compared to the properties of casting alloys.

EXAMPLE 1

According to the invention, the raw powder mixture comprised: (a) 60 wt. % of hydrogenated titanium powder containing 3.8 wt. % of hydrogen and having particle size less than 120 μm, (b) 30 wt. % of underseparated titanium powder containing 0.9% chlorine and 0.8% of magnesium and having particle size less than 100 μm, and (c) 10 wt. % of the 60Al-40V master alloy powder having particle size less than 65 μm. These powders are blended for 6 hours and compacted in a die at 600 MPa into the preform having a relative density of 74%. Then, net-shaped compacts are exposed at 350° C. for 60 min during heating in vacuum furnace for evacuation of chlorine and magnesium from the material.

The preform was heated in a vacuum of $10^{-2}$ Pa at the rate of 10° C./min up to 1350° C. No liquid phases were at this temperature, yet. During the heating process, the pressure in the furnace chamber was increased to $10^4$ Pa in the temperature range of 400-900° C. resulting in hydrogen being emitted from the hydrogenated titanium powder. The pressure in the chamber was decreased gradually to $10^{-2}$ Pa during heating to over 900° C. Then, the preform was sintered for 4 hours at 1350° C. The obtained article was studied using microstructural analysis, X-ray, and microspectral analysis, which confirmed that the produced metal is a chemically and structurally homogeneous alloy Ti-6Al-4V having a density of 98.8% of the theoretical value. The tensile strength of the obtained alloy was 960 MPa and the elongation was 11%.

EXAMPLE 2

The raw powder mixture comprised: (a) 50 wt. % of hydrogenated titanium powder containing 3.8 wt. % of hydrogen and having particle size less than 100 μm, (b) 40 wt. % of hydrogenated titanium powder containing 1.0 wt. % of hydrogen and having particle size less than 40 μm, and (c) 10 wt. % of the 60Al-40V master alloy powder having particle size less than 40 μm. These powders are blended for 6 hours and compacted at 420 MPa into the preform having a relative density of 76%.

The preform was heated in a vacuum of $10^{-2}$ Pa at the rate of 10° C./min up to 1250° C. During the heating process, the pressure in the furnace chamber was increased to $10^4$ Pa in the temperature range of 400-900° C. resulting in hydrogen being emitted from the hydrogenated titanium powder. The pressure in the chamber was decreased gradually to $10^{-2}$ Pa during heating to over 900° C. Then, the preform was sintered at 1250° C. for 4 h. The obtained article was studied using microstructural analysis, X-ray, and microspectral analysis, which confirmed that the produced material is a chemically and structurally homogeneous alloy Ti-6Al-4V having a density of 99% of the theoretical value. The tensile strength of the obtained alloy was 950 MPa and the elongation was 12%.

EXAMPLE 3

The raw powder mixture comprised: (a) 60 wt. % of hydrogenated titanium powder containing 3.7 wt. % of hydrogen and having particle size less than 160 μm, (b) 30 wt. % of the standard grade titanium powder having particle size less than 100 μm, and (c) 10 wt. % of the 60Al-40V master alloy powder having particle size less than 65 μm. These powders are blended for 6 hours and compacted at 400 MPa into the preform having a relative density of 70%. Then, net-shaped compact is heated with the rate of 15° C./min up to 1250° C. for sintering. The preform was heated to 400° C. in vacuum of less than $10^{-2}$ Pa and in a range of 400-900° C. at pressure up to $10^4$ Pa controlled by hydrogen being emitted due to the decomposition of titanium hydride. The pressure in the chamber was decreased gradually to $10^{-2}$ Pa during heating to over 900° C. Finally, the preform was sintered for 6 hours at 1250° C. No liquid phases were at this temperature, yet. The obtained titanium alloy article was studied using microstructural analysis, X-ray, and microspectral analysis, which confirmed that the produced metal is a chemically and structurally homogeneous alloy Ti-6Al-4V having a density of 98.6% of the theoretical value. The tensile strength of the obtained alloy was 950 MPa and the elongation was 10%.

EXAMPLE 4

The raw powder mixture comprised: (a) 80 wt. % of hydrogenated titanium powder containing 3.9 wt. % of hydrogen and having particle size less than 100 μm, (b) 10 wt. % of underseparated titanium powder containing 1.7% chlorine and 1.5% of magnesium and having particle size less than 100 μm, and (c) 10 wt. % of the 60Al-40V master alloy powder having particle size less than 65 μm. These powders are blended for 6 hours and compacted in die at 750 MPa into the preform having a relative density of 76%. Then, during heating in vacuum furnace net-shaped compacts are exposed at 300° C. for 30 min for evacuation of chlorine and magnesium from material. The preform was then heated in a vacuum of $10^{-2}$ Pa at the rate of 15° C./min up to 1350° C. No liquid phases were at this temperature, yet. During the heating process, the pressure in the furnace chamber was increased to $10^4$ Pa in the temperature range of 400-900° C. resulting in hydrogen being emitted from the hydrogenated titanium powder. The pressure in the chamber was decreased gradually to $10^{-2}$ Pa during heating to over 900° C. Then, the preform was sintered for 4 hours at 1350° C. The obtained article was studied using microstructural analysis, X-ray, and microspectral analysis, which confirmed that the produced metal is a chemically and structurally homogeneous alloy Ti-6Al-4V having a density of 98.9% of the theoretical value. The tensile strength of the obtained alloy was 960 MPa and the elongation was 10.6%.

The innovated technology is suitable for applications both in a lab testing and a serial manufacture of sintered articles from titanium alloys.

We claim:

1. A cost-effective method for manufacturing flat or shaped articles from titanium powder compositions comprising:

(a) mixing an underseparated titanium powder manufactured from underseparated titanium sponge, optionally Commercially Pure (C.P.) titanium powder, and titanium hydride powders containing different amounts of hydrogen, and master alloys or elemental alloying powders, in a ratio providing a composition of the required alloy to form a blended composition comprising:

underseparated titanium powder having particles with sizes less than 500 μm manufactured from underseparated titanium sponge comprising up to 2 wt. % of chlorine and up to 2 wt. % of magnesium, hydrogenated titanium powder, comprising a mixture of two hydrogenated powders A and B each of which contain different amounts of hydrogen, such that hydrogenated powder A comprises an amount of hydrogen in a range of 0.2-1 wt. % and hydrogenated powder B comprises an amount of hydrogen in a range of 2-3.9 wt. %, 0-90 wt. % of C.P. standard grade refined titanium powder, and alloying metal powders selected from master alloys or elemental powders, wherein a ratio between particle sizes of titanium powder:hydrogenated titanium powder: alloying powders in said blended composition is in a range of 1:(0.5-2):(0.01-0.7), (b) compacting the obtained blended composition by die pressing, direct powder rolling, cold isostatic pressing, or metal injection molding at pressures in the range of 400-960 MPa to provide a green compact having a density at least 60% of theoretical density and containing a uniform network of fine pores to accelerate healing during subsequent sintering, wherein said compacting provides additional crushing of brittle hydrogenated titanium particles to reduce pore size and improve the uniformity of pore distribution, thereby promoting the subsequent sintering temperatures of said green compacts whereby an increased hydrogen content is retained in the green compact in order to provide emission of hydrogen and a high hydrogen partial pressure during subsequent chemical cleaning and sintering steps, (c) chemical cleaning and refining said green compact by heating to 300-900° C. and holding the green compact at such temperatures for at least 30 minutes thereby reacting chlorine, magnesium, oxygen, and other impurities with hydrogen emitted through decomposition of titanium hydride in the green compact, whereby an increased partial pressure of hydrogen up to $10^4$ Pa is maintained in the chemical cleaning and refining chamber at temperatures in the range of 400-900° C. thereby allowing hydrogen to remain in the crystalline lattice of titanium, to form cleaned and refined green compact, (d) heating the cleaned and refined green compact in vacuum at a temperature range of 1000-1350° C. and holding such temperature for at least 30 minutes, thereby sintering the β-phase of titanium to form a sintered compact, and (e) cooling the sintered compact to form a flat or shaped article.

2. The cost-effective method for manufacturing flat or shaped articles from titanium powder compositions according to claim 1, wherein said chemical cleaning and refining comprises:

initial heating in a furnace chamber to 400° C. in vacuum of less than $10^{-2}$ Pa, then subsequent heating to a temperature in the range of 400-900° C. at pressures up to $10^4$ Pa, which pressures are controlled by hydrogen being emitted due to a decomposition of titanium hydride contained in the green compact, and finally, heating to a sintering temperature over 900° C. at a pressure continually decreasing to the starting vacuum level, thereby providing purification of original titanium powder contaminated with chlorine, magnesium, oxygen and other impurities.

3. The cost-effective method for manufacturing flat or shaped articles from titanium powder compositions according to claim 1, wherein the resulting sintered titanium alloy of the flat or shaped article contains less than 0.2 wt. % of oxygen, less than 0.006 wt. % of hydrogen, less than 0.05 wt. % of chlorine, less than 0.05 wt. % of magnesium, and wherein the resulting titanium alloy has a final porosity less than 1.5% at pore sizes less than 20 μm.

4. The cost-effective method for manufacturing flat or shaped articles from titanium powder compositions according to claim 1, wherein the final sintered titanium alloy articles has a tensile strength equal to or higher than 950 MPa at an elongation in the range of 10-12%.

5. The cost-effective method for manufacturing flat or shaped articles from titanium powder according to claim 1, wherein the underseparated titanium powder is present in an amount of 10-50 wt. % of the blended composition.

6. The cost-effective method for manufacturing flat or shaped articles from titanium powder according to claim 1, wherein the hydrogenated titanium powder is present in an amount of 10-90 wt. % of the blended composition.

7. The cost-effective method for manufacturing flat or shaped articles from titanium powder according to claim 1, wherein the alloying metal powders are present in an amount of 5-50 wt. % of the blended composition.

8. The cost-effective method for manufacturing flat or shaped articles from titanium powder according to claim 1, wherein the underseparated titanium powder is present in an amount of 10-20 wt. % of the blended composition.

9. The cost-effective method for manufacturing flat or shaped articles from titanium powder according to claim 1, wherein the underseparated titanium powder comprises 20-50 wt. % of the blended composition, and comprises up to 1 wt. % of chlorine and up to 1 wt. % of magnesium.

10. The cost-effective method for manufacturing flat or shaped articles from titanium powder according to claim 1, wherein emitted hydrogen is not present during final stages of sintering.

11. The cost-effective method for manufacturing flat or shaped articles from titanium powder according to claim 1, wherein the flat or shaped article comprises a Ti-6Al-4V alloy.

12. The cost-effective method for manufacturing flat or shaped articles from titanium powder according to claim 1, wherein the master alloy comprises 60Al-40V.

13. A cost-effective method for manufacturing flat or shaped articles from titanium powder compositions comprising:

(a) Commercially Pure (C.P.) titanium powder, and titanium hydride powders containing different amounts of hydrogen, and master alloys or elemental alloying powders, in a ratio providing a composition of the required alloy to form a blend composition comprising:

hydrogenated titanium powder, comprising a mixture of two hydrogenated powders A and B each of which contain different amounts of hydrogen, such that hydrogenated powder A comprises an amount of hydrogen in a range of 0.2-1 wt. % and hydrogenated powder B comprises an amount of hydrogen in a range of 2-3.9 wt. %, 0-90 wt. % of C.P. standard grade refined titanium powder, and alloying metal powders selected from master alloys or elemental powders, wherein a ratio between particle sizes of titanium powder: hydrogenated titanium powder: alloying powders is in a range of 1:(0.5-2):(0.01-0.7), (b) compacting the obtained blended composition by die pressing, direct powder rolling, cold isostatic pressing, or metal injection molding at pressures in the range of 400-960 MPa to provide a green compact having a density at least 60% of theoretical density and containing a uniform network of fine pores to accelerate healing during subsequent sintering, wherein said compacting provides additional crushing of brittle hydrogenated titanium particles to reduce pore size and improve the uniformity of pore distribution, thereby promoting the subsequent sintering temperatures of said green compacts whereby an increased hydrogen content is retained in the green compact in order to provide emission of hydrogen and a high hydrogen partial pressure during subsequent chemical cleaning and sintering steps, (c) chemical cleaning and refining said green compact by heating to 300-900° C. and holding the green compact at such temperatures for at least 30 minutes thereby reacting chlorine, magnesium, oxygen, and other impurities with hydrogen emitted through decomposition of titanium hydride in the green compact, whereby an increased partial pressure of hydrogen up to $10^4$ Pa is maintained in the chemical cleaning and refining chamber at temperatures in the range of 400-900° C. thereby allowing hydrogen to remain in the crystalline lattice of titanium, to form cleaned and refined green compact, (d) heating the cleaned and refined green compact in vacuum at a temperature range of 1000-1350° C. and holding such temperature for at least 30 minutes, thereby sintering the β-phase of titanium to form a sintered compact, and (e) cooling the sintered compact to form a flat or shaped article.

14. The cost-effective method for manufacturing flat or shaped articles from titanium powder accordinq to claim 13, wherein the final sintered titanium alloy article has a tensile strength equal to or higher than 950 MPa at an elongation in the range of 10-12%.

* * * * *